United States Patent [19]

Sheppard

[11] 4,033,581

[45] July 5, 1977

[54] FOOTBALL KICKER'S STRAP

[76] Inventor: Jay W. Sheppard, 1426 Sandra Drive, Fort Myers, Fla. 33901

[22] Filed: Dec. 15, 1975

[21] Appl. No.: 640,930

[52] U.S. Cl. ..... 273/55 B; 128/80 E

[51] Int. Cl.[2] ..... A63B 67/00

[58] Field of Search ..... 273/55 B, 29 R, 29 A, 273/75, 73 R, 191 R, 191 B, 188 R, 188 A, 189 R, 190 B, 191 B, 54 B, DIG. 17, DIG. 18, DIG. 19; 36/2.5 A, 128; 128/77, 80 R, 80 G, 80 E, 80 H, 184 R, 184 C

[56] References Cited

UNITED STATES PATENTS

| | | | |
|---|---|---|---|
| 3,527,209 | 9/1970 | Baker | 128/80 E |

FOREIGN PATENTS OR APPLICATIONS

| | | | |
|---|---|---|---|
| 548,527 | 3/1932 | Germany | 128/80 E |
| 817,195 | 10/1928 | United Kingdom | 128/80 H |
| 119,343 | 10/1918 | United Kingdom | 128/80 E |
| 7,337 | 4/1937 | United Kingdom | 128/80 E |

*Primary Examiner*—Anton O. Oechsle

*Assistant Examiner*—T. Brown

*Attorney, Agent, or Firm*—Clarence A. O'Brien; Harvey B. Jacobson

[57] ABSTRACT

A kicking strap for use by individuals engaged in kicking a football from a kicking tee, such as when place kicking the football in order to score a point after a touchdown or in order to score a field goal or when kicking off. The strap includes two components, one of which is a relatively wide strap which encircles the leg just below the knee and a relatively narrow strap attached to the wide strap and extending under the toe portion of a football shoe immediately rearwardly of the forwardmost cleats. The narrow strap is adjustably connected to the wide strap to enable the kicking strap to be effectively used by individuals having different leg and foot dimensions and physiological characteristics. The kicking strap functions to assure rigidity of the foot and ankle during the kicking motion which is essential to accuracy of the kick and distance obtained since the kicking strap enables maximum power of the leg swing to be transferred to the portion of the foot and football shoe which actually engages the football.

8 Claims, 4 Drawing Figures

FOOTBALL KICKER'S STRAP

BACKGROUND OF THE INVENTION

1. Field of the Invention

The present invention generally relates to an attachment for use by individuals engaged in kicking a football which has been placed on the ground and held in position by another player or placed on a kicking tee so that the ball will be in generally an upright condition but slanted slightly toward the kicker in a well known manner. The attachment of the present invention is in the form of a kicking strap which includes a wide strap encircling the leg above the calf and adjacent the knee of the kicker and a narrow strap adjustably connected thereto and extending diagonally in spaced relation to the ankle joint and encircling the toe portion of the foot and football shoe so that the foot and shinbone are oriented in substantially perpendicular relation and forming generally a right triangle with the narrow strap generally defining a hypotenuse of the right triangle thereby providing an arrangement for maintaining the foot in rigid condition in relation to the ankle and adjacent portion of the leg.

2. Description of the Prior Art

Various devices have been provided for facilitating the kicking of a football when it has been placed on a kicking tee or held in an upright but slightly inclined position another player. Such devices include specially constructed shoes having rigid toe components and the like and also devices have been provided for reinforcing and attempting to rigidify the ankle joint. The following U.S. patents are exemplary of the developments which have taken place in this field of endeavor:

U.S. Pat. Nos.:

3,328,030 — June 27, 1967
3,348,842 — Oct. 24, 1967
3,534,957 — Oct. 20, 1970
3,618,946 — Nov. 9, 1971.

SUMMARY OF THE INVENTION

An object of the invention is to provide a football kicker's strap including a relatively wide strap which encircles the leg immediately below the knee above the calf and a relatively narrow strap which is looped under the toe portion of a football shoe and adjustably connected to the wide strap to maintain the foot and leg in substantially perpendicular, rigid relation when kicking the football.

Another object of the invention is to provide a football kicker's strap which forms a hypotenuse of a right triangle with the foot forming one leg of the right triangle and the portion of the leg between the ankle and upper calf defining the other side of the right triangle thereby enabling the foot to be retained in a rigid position for better accuracy and adding leg power to the kick for increasing the distance the ball is kicked.

Another object of the invention is to provide a football kicker's strap in which the effective length of the strap may be adjusted to enable individuals to custom fit the strap to their own physiological requirements and the looping of the strap under the toe portion of the football shoe enables the strap to be easily placed in position for use and just as easily removed.

Still another object of the invention is to provide a football kicker's strap in accordance with the preceding objects in which the strap permits relaxation of the dorsiflexor muscle (foot extensors) which must otherwise be held rigid and taut in order to insure rigidity of the ankle. This enables the kicker to concentrate on his leg swing so that more consistent accuracy greater kicking distance is obtained.

These together with other objects and advantages which will become subsequently apparent recisde in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
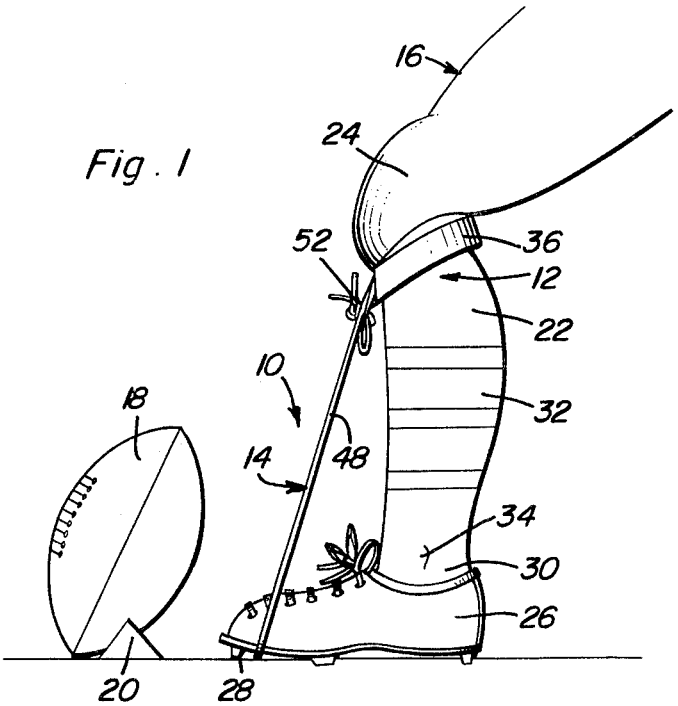
FIG. 1 is a side elevational view of the kicker's strap of the present invention oriented in operative position.

The football kicker's strap of the present invention is generally designated by reference numeral 10 and includes two components with one being a generally wide strap designated by numeral 12 and the other being a relatively narrow strap designated by numeral 14. The football kicker's strap 10 is associated with the leg 16 of an individual kicking a football 18 that is resting on a conventional kicking tee 20 or the football may be held in the desired inclined but generally upright position by another player. This positioning of the football usually occurs during kickoffs, attempts for a point after a touchdown has been scored and attempts to kick a field goal.

The wide strap 12 encircles the leg 16 at the upper calf 22 and just below the knee 24 while the narrow strap 14 extends under the football kicking shoe 26 adjacent the toe end thereof and immediately rearwardly of the two front cleats 28 that are normally provided on conventional football shoes. The cleat arrangement in some instances varies but, in any event, the narrow strap 14 would extend under the toe portion of the football shoe 26 immediately rearwardly of the forwardmost cleats or cleat as the case may be. The foot 30 of the individual using the device is then retained substantially perpendicular to the shin 32 with the ankle joint 34 being held rigid since the narrow strap 14, in effect, forms a right triangle with the foot 30 defining one side of the right triangle and the shin 32 of the leg 16 forming the other side of the right triangle in perpendicular relation to the foot 30 and the strap 14 defining the hypotenuse of the right triangle thus enabling the ankle joint 34 to be maintained in a rigid condition.

Figure 2:
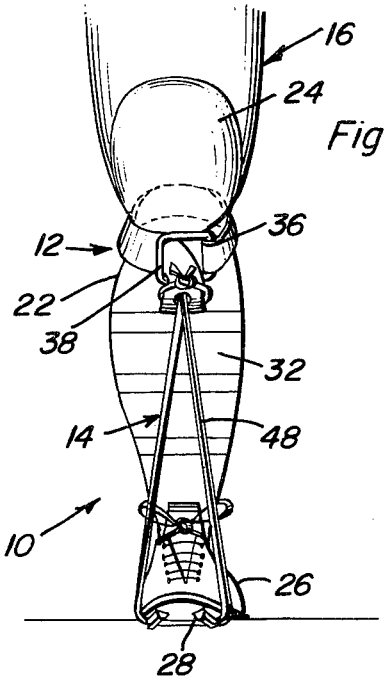
FIG. 2 is a front elevational view of the kicker's strap illustrating its relationship to the foot and leg.
Figure 3:
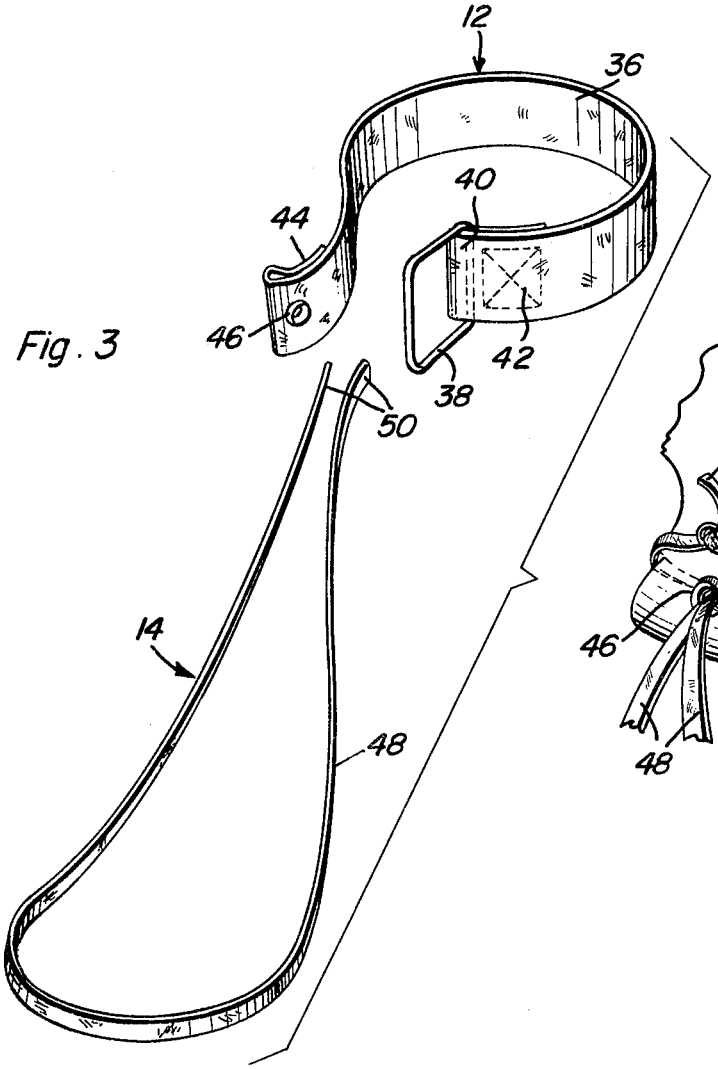
FIG. 3 is an exploded perspective view of the two straps forming the football kicker's strap of the present invention.

The strap 12 is in the form of a relatively wide, elongated strap member 36 of leather or similar relatively stiff material, preferably approximately 1½ inches wide and provided with a buckle 38 at one end thereof. The buckle 38 is in the form of a rectangular or square rigid metal member or other suitable rigid material secured to the strap by a hem 40 formed therein by stitching 42, or the like. The other end of the strap member 36 is reversely folded at 44 and provided with a grommet or eyelet 46 therethrough. The reversely folded end 44 of the strap member 36 is inserted through the buckle 38 with the strap member 36 encircling the leg 16 at the upper calf portion 22, as illustrated in FIGS. 1 and 2, with the free end portion having the grommet 46 therein extending forwardly from the buckle 38. This construction enables the length dimensions of the strap member 36 to be adjusted so that it will fit users having different dimensional characteristics of the upper calf portion of the leg.

Figure 4:
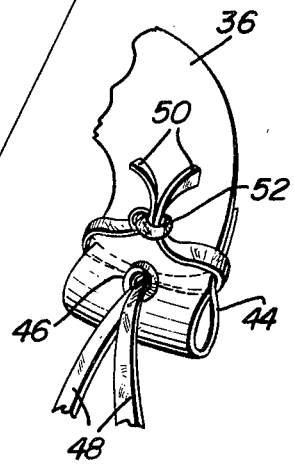
FIG. 4 is a fragmental perspective view illustrating the manner in which the adjustable narrow strap is attached to the wide strap which encircles the leg just below the knee.

The narrow strap 14 includes an elongated flexible strap member 48 of leather or similar material, preferably ⅜ inch wide, although this dimension may vary. In assembling the narrow strap member 48 with the wide strap member 36, the free ends 50 of the strap member 48 are inserted through the grommet 46, looped around the free end portion 44 of the strap member 36 and tied into a knot 52, as illustrated in FIG. 4, thus adjustably securing the strap member 48 to the strap member 36, thus enabling the effective length of the strap member 48 to be adjusted to properly orient the foot 30 in relation to the shin 32 of the leg 16. The football kicker's strap 10 will effectively concentrate leg power and transfer it effectively to the foot. Also, the toe portion of the foot and football shoe will be retained at the desired elevation for proper ball impact. The wide leg strap 12 is adjusted for tension automatically to the desired tightness when the narrow shoe strap 14 is attached to the shoe by reason of a natural opposition right triangle created by the angle of the foot bones and leg bone. After the narrow shoe strap has been adjusted and the knot formed on the upper side of the wide leg strap after looping the narrow shoe strap around the backside of the wide leg strap 12, the narrow shoe strap 14 may be slipped on and off the shoe as needed for kicking, thus enabling the kicker to perform other functions without any hindrance whatsoever since the football kicking strap may be quickly and easily removed after use and may be assembled for use and will automatically assume a proper fit since it has been previously adjusted to the individual user.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A football kicker's strap comprising a relatively wide leg strap adapted to encircle the upper calf portion of the leg immediately below the knee, a narrow shoe strap adapted to extend under the football shoe adjacent the toe end thereof and extend diagonally upwardly toward the upper calf portion of the kicker's leg, and means adjustably connecting the leg strap and shoe strap to form a hypotenuse of a right triangle in which the lower leg portion of the kicker forms one side of the right triangle and the foot of the kicker defines the other side of the right triangle thereby enabling the ankle joint to be maintained in a rigid condition with the toe portion of the kicker's being elevated to the desired position for proper ball impact, said leg strap including a loop buckle on one end and a grommet on the other with the grommeted end of the wide strap extending through the loop buckle, said leg strap and shoe strap being constructed of leather with the leg strap being approximately 1½ inches wide and the shoe strap being approximately ⅜ inch wide, said buckle being anchored to the leg strap by a hem formed in the end of the leg strap by stitching, the grommet equipped end of the leg strap being reversely folded with the grommet extending through both layers of the reversely folded leg strap for rigidifying the grommet.

2. The structure as defined in claim 1 wherein the means connecting the leg strap and shoe strap includes free end portions of the shoe strap extending through the grommet in the end of the leg strap outwardly of the buckle, the free ends of the shoe strap extending through the grommet being looped around the end of the leg strap and secured with a knot to enable the dimensional characteristics of the kicker's strap to be adjusted for each individual user.

3. For use by a kicker when kicking a football placed in a generally upright, inclined position in which the toe of the kicker and football shoe must be slightly elevated for proper ball impact, a kicker's strap comprising a leg strap encircling the leg of the kicker immediately below the knee at the upper calf portion of the leg and a shoe strap connected to the leg strap and extending diagonally downwardly and looping under the football kicking shoe adjacent to but spaced rearwardly from the toe portion thereof to enable impact of the toe portion of the shoe with the football without inteference from the shoe strap, means adjustably connecting said shoe strap to the leg strap immediately below and forwardly of the knee for maintaining the foot and leg in substantially perpendicular relation with the length of the foot and leg up to the leg strap forming elongated sides of a right triangle and the football kicker's strap defining the hypotenuse of the right triangle with the distance between the leg strap adjacent the knee and the ankle defining the longest possible lever arm acting on the torque in the ankle thereby enabling greater accuracy and distance for the kicked football resulting from transmission of leg power through a substantially rigid ankle joint to the foot.

4. The structure as defined in claim 3 wherein said connecting means includes loop means on one end of the leg strap through which the other end of the leg strap extends, said shoe strap being connected to the end of the leg strap which extends through the loop means thereby automatically tightening the leg strap when tension is exerted on the shoe strap.

5. The structure as defined in claim 4 wherein said loop means is in the form of a rigid loop, said other end of the leg strap having a grommet therein through which the shoe strap extends with the free ends of the shoe strap being tied to the leg strap adjacent the grommet.

6. The structure as defined in claim 3 wherein said leg strap includes means adjustably connecting the ends thereof to retain the leg strap in encircling relation to the leg of the kicker said means adjustably connecting the shoe strap to the leg strap enables adjustment to fit individual kikers and to enable each kicker to obtain optimum straight line condition of the football shoe for impact with the football.

7. The structure as defined in claim 6 wherein said means connecting the shoe strap to the leg strap includes an aperture in a free end of the leg strap disposed at the front of the leg, said shoe strap including a central portion extending under the toe portion of the football shoe immediately inwardly of the outermost cleat means thereon, the free ends of said shoe strap extending through the aperture and adjustably tied around the free end of the leg strap adjacent the aperture.

8. The structure as defined in claim 7 wherein said means adjustably connecting the ends of the leg strap includes a rigid loop secured to one end of the leg strap and the free end of the strap having the aperture herein extending through said loop and projecting slightly forwardly therefrom to enable passage of the free ends of the shoe strap therethrough, said leg strap and shoe strap being constructed of flexible material having stable length dimensional characteristics to enable repetitive use thereof without adjustment so that a kicker engaged in football competition can quickly assemble the kicker's strap for repetitive use during a game once the strap has been adjusted to his particular leg and foot dimensional characteristics and kicking style, said shoe strap being relatively narrow for extending between adjacent cleat means on the football shoe and the leg strap being relatively wide so that tension forces exerted thereon will not cause the leg strap to cut into the surface of the leg.

* * * * *